US011969104B2

(12) United States Patent
Mittal

(10) Patent No.: US 11,969,104 B2
(45) Date of Patent: Apr. 30, 2024

(54) MATTRESS COVERS WITH SECRET TUCK AND METHODS OF MANUFACTURE

(71) Applicant: Sysco Guest Supply, LLC, Somerset, NJ (US)

(72) Inventor: Khushboo Mittal, Chatham, NJ (US)

(73) Assignee: Sysco Guest Supply, LLC, Somerset, NJ (US)

( * ) Notice: Subject to any disclaimer, the term of this patent is extended or adjusted under 35 U.S.C. 154(b) by 122 days.

(21) Appl. No.: 17/209,139

(22) Filed: Mar. 22, 2021

(65) Prior Publication Data

US 2022/0296004 A1 Sep. 22, 2022

(51) Int. Cl.
*A47C 31/10* (2006.01)
*A47G 9/02* (2006.01)

(52) U.S. Cl.
CPC ..... *A47C 31/105* (2013.01); *A47G 9/0207* (2013.01); *A47G 9/0223* (2013.01); *A47G 9/0238* (2013.01)

(58) Field of Classification Search
CPC ... A47C 31/105; A47C 21/028; A47C 21/022; A47G 9/0238; A47G 9/02; A47G 9/0246; A47G 9/0223; A47G 9/0207; A47G 9/04; A47G 9/0261; A47G 9/0253; D10B 2503/062
See application file for complete search history.

(56) References Cited

U.S. PATENT DOCUMENTS 1,732,663 A * 10/1929 Schimmel ..... A47C 31/105 38/140
3,824,640 A * 7/1974 Golden ..... A47G 9/0284 5/485
8,370,974 B2 * 2/2013 Caines ..... A47G 9/0246 5/497
2004/0200000 A1 * 10/2004 Harbin ..... A47G 9/0246 5/497
2005/0071924 A1 4/2005 Ratigan
(Continued)

FOREIGN PATENT DOCUMENTS

GB 2023419 A * 1/1980 ..... A47G 9/0261
GB 2047084 A 11/1980

OTHER PUBLICATIONS

"Warp." Merriam-Webster, Merriam-Webster, https://www.merriam-webster.com/dictionary/warp.*
(Continued)

*Primary Examiner* — David R Hare
*Assistant Examiner* — Madison Emanski
(74) *Attorney, Agent, or Firm* — Lowenstein Sandler LLP

(57) ABSTRACT

A mattress cover includes a fabric substrate having a top surface, a bottom surface, a head portion, a foot portion, a first length, and a first width, a secret tuck portion attached to the foot portion on the bottom surface of the fabric substrate, the secret tuck portion having a second length and a second width. The second width is less than the first width. A method of making a mattress cover includes providing a fabric substrate having a top surface, a bottom surface, a head portion, a foot portion, a first length, and a first width, and attaching a secret tuck portion to the foot portion on the bottom surface of the fabric substrate, the secret tuck portion having a second length and a second width. The second width is less than the first width.

20 Claims, 2 Drawing Sheets

(56) References Cited

U.S. PATENT DOCUMENTS

| | | | | |
|---|---|---|---|---|
| 2006/0168726 | A1* | 8/2006 | Cushing | A47G 9/0246 5/497 |
| 2007/0056100 | A1* | 3/2007 | Stewart | A47G 9/0246 5/497 |
| 2007/0151028 | A1* | 7/2007 | Bauer | A47G 9/0207 5/482 |
| 2008/0072378 | A1* | 3/2008 | Head | A47G 9/02 5/497 |
| 2013/0117933 | A1* | 5/2013 | Mickle | A47G 9/08 5/413 R |
| 2014/0331405 | A1* | 11/2014 | Wetmore | A47G 9/0261 5/493 |
| 2016/0058214 | A1* | 3/2016 | Preston | A47G 9/0238 5/497 |
| 2017/0020310 | A1* | 1/2017 | Garg | D03D 13/008 |
| 2018/0184819 | A1* | 7/2018 | Gaudyn | A47G 9/04 |
| 2018/0360227 | A1* | 12/2018 | Martin | D04H 3/011 |
| 2019/0320807 | A1* | 10/2019 | Backs | A47C 21/022 |

OTHER PUBLICATIONS

"Hem." Dictionary.com, www.dictionary.com/browse/hem.*

"Hem." Collins Dictionary, www.collinsdictionary.com/us/dictionary/english/sewing.*

"Hem." Collins Dictionary, www.collinsdictionary.com/us/dictionary/english/hem.*

SmartDraw (AutoCAD), Drawing Program creator, https://www.smartdraw.com/?id=104607&gclid=CjwKCAjwsKqoBhBPEiwALrrqiPfOUqje4DCiL07P52x6z7NT2E_WtAKqDGdLuJT3aL5_ZFoVBO7vJBoC9aoQAvD_BwE.*

PCTUS2022021308 International Search Report and Written Opinion dated Jun. 24, 2022, 14 pgs.

* cited by examiner

MATTRESS COVERS WITH SECRET TUCK AND METHODS OF MANUFACTURE

TECHNICAL FIELD

The present disclosure generally relates to mattress covers and their methods of manufacture. More specifically, embodiments relate to mattress covers that may be used in households, hotels, motels, and healthcare facilities, and their methods of manufacture.

BACKGROUND

A conventional bed includes a box spring or bottom mattress or platform and a top mattress. Top mattresses are relatively heavy items. The weight of a mattress varies as a function of the coil core, the gauge of the coil, and the type of material or foam material used. An average king size mattress weighs between 85 and 115 pounds. High end king size mattresses with latex or memory foam can weigh as much as 300 pounds.

Hotel and motel chains as well as healthcare facilities which include hospitals, nursing homes and extended care facilities (hereinafter "commercial facilities") are known to only use flat sheets in their facilities due to the lower cost of flat sheets relative to fitted sheets and the desire to maintain fewer items in their respective inventories. As such, in order to properly make the beds in such facilities with flat sheets, housekeeping personnel need to lift the top mattress, which can be quite heavy, as discussed above. More particularly, in such facilities beds are made with a top sheet and a bottom sheet and a blanket. Both the top sheet and the bottom sheets are flat sheets.

In order to properly make the bed, the top and bottom sheets are tucked in between the top mattress and the box spring. More specifically, the bottom sheet is placed on the bed so that an equal amount of the sheet hangs off each side of the bed and an equal amount of the sheet hangs off the head and foot regions of the bed. The excess is tucked in at the head and foot regions of the bed to form so called "hospital corners." Next, the excess portions of the bottom sheet are tucked in next between the mattress and the box spring. The top sheet is then placed on top of the bottom sheet and placed and tucked in the same manner as the bottom sheet with hospital style corners except the head region is left open. In other words, only the foot and side portions of the top sheet are tucked between the mattress and the box spring. Next, a blanket is placed on the bed and may be tucked in the same manner as the top sheet.

In order to tuck the top and bottom sheets between the mattress and the box spring, the top mattress must normally be lifted. As mentioned above, mattresses can weigh up to 300 pounds. In order to make a bed, a housekeeping employee may need to lift a mattress up to ten (10) times per bed; four (4) times for the bottom sheet and three (3) times for the top sheet and the blanket. Assuming that each housekeeping employee in a hotel, motel, or healthcare facility makes at least 20-30 beds in a single shift, each housekeeping employee would typically lift a mattress at least 150-200 times per shift. Since bed making is a daily chore, housekeeping employees probably lift mattresses 150-200 times per shift on a daily basis.

Such sustained and repetitive lifting leads to employees developing back problems, resulting in employees missing work or, in severe cases, being placed on disability. Measures have been taken to mitigate such health problems. For example, simply using fitted sheets for the lower sheet reduces the number of times the mattress is to be lifted by 40%. However, fitted sheets do not provide the "hospital corners" in the lower bed sheets that hospitals are known for. Moreover, even using fitted sheets for the bottom sheet still requires a housekeeping employee to lift mattresses at least 90-160 times per day using the example above.

The use of fitted sheets is not without its drawbacks. For example, fitted sheets cost more than flat sheets. Also, frequent washing of sheets in commercial facilities tends to wear out the elastic in fitted sheets. As such, fitted sheets used in such facilities need to be replaced in applications in commercial facilities more frequently than straight sheets.

Thus, there is a need for further minimizing the need for housekeeping employees to lift mattresses while still making the bed look aesthetically neat.

SUMMARY

Briefly, the present invention relates to a mattress cover that may advantageously provide the benefits of being modular in terms of size and shape, easily removable and replaceable, comfortable and secure, all while maintaining an aesthetically, orderly, or neat and trim look.

More specifically, the present invention relates to a system and method for facilitating making beds of all sizes with one or more mattress covers by minimizing lifting of the mattress so that mattress cover can be tucked between the upper mattress and the box spring or platform without lifting the top mattress as many times. As such, flat sheets and blankets made in accordance with the present invention can be tucked between a mattress and box spring or platform virtually effortlessly without the need to lift the top mattress as many times. The present invention thus increases the efficiency of the housekeeping staff leaving more time for the housekeeping staff to attend to the rest of the room.

Accordingly, one example embodiment is a mattress cover including a fabric substrate having a top surface, a bottom surface, a head portion, a foot portion, a first length, and a first width. The mattress cover also includes a secret tuck portion attached to the foot portion on the bottom surface of the fabric substrate, the secret tuck portion having a second length and a second width. In one embodiment, the second width is less than the first width. The second length may be significantly less than the first length. The secret tuck portion is stitched or sewn to the foot portion on the bottom surface of the fabric substrate, or the secret tuck portion may be attached to the foot portion on the bottom surface of the fabric substrate using a hook and loop type fastener or Velcro®.

In one embodiment, the second width is equal to a width of a mattress on which the mattress cover is used. The mattress may be a twin, twin XL, full, queen, king, California king, or custom sized mattress. The secret tuck portion is attached to the foot portion on the bottom surface of the fabric substrate at about 60-90% of the second length, or preferably about 70-80% of the second length. The secret tuck portion can be made of the same material as the fabric substrate or of a different material.

The mattress cover may include one or more layers of a second fabric. At least a portion of the side portions is configured to be resilient and extendible along a depth of a mattress such that the mattress cover is releasably secured to the mattress. The at least one resilient member is further configured to be sandwiched between two layers of a fabric. The at least one resilient member is attached along corners that conform with corners of the mattress. The at least one resilient member is attached in a vertical direction along the depth of the mattress or at an angle relative to the vertical direction.

A fabric weight of the fabric substrate, the second fabric, and/or the secret tuck portion can be in the range of about 10 gsm to 1000 gsm. The fabric substrate, the second fabric, and/or the secret tuck portion may include at least one of cotton, polyester, nylon, and rayon yarns in either warp or weft direction. The fabric substrate, the second fabric, and/or the secret tuck portion may include 100% polyester yarns. The fabric substrate, the second fabric, and/or the secret tuck portion may include at least one of a woven, knitted, nonwoven, and extruded base. The fabric substrate, the second fabric, and/or the secret tuck portion may have a patterned or textured surface. The yarn density, for yarn used in the fabric substrate, the second fabric, and/or the secret tuck portion can be the range of about 25 to 500 denier.

In one embodiment, a portion of the head portion is folded backwards towards the bottom surface of the mattress cover, and seams are provided along an outer edge of the first and second side portions to retain the head portion in a folded position. Additional seaming may be provided along the folded portion and across the width of the mattress cover. In one embodiment, the secret tuck portion may include a sheeting fabric. The secret tuck portion may be foldable towards the bottom surface and concealed when not in use or when not tucked under the mattress.

Another example embodiment is a method of making a mattress cover including providing a fabric substrate having a top surface, a bottom surface, a head portion, a foot portion, a first length, and a first width, and attaching a secret tuck portion to the foot portion on the bottom surface of the fabric substrate, the secret tuck portion having a second length and a second width, wherein the second width is less than the first width. The second length may be significantly less than the first length. The secret tuck portion is stitched or sewn to the foot portion on the bottom surface of the fabric substrate, or the secret tuck portion may be attached to the foot portion on the bottom surface of the fabric substrate using a hook and loop type fastener or Velcro®.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

So that the manner in which the features, advantages and objects of the invention, as well as others which may become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only example embodiments of the invention and is therefore not to be considered limiting of its scope as the invention may admit to other equally effective embodiments.

DETAILED DESCRIPTION

The methods and mattress covers of the present disclosure can now be described more fully hereinafter with reference to the accompanying drawings in which embodiments are shown. The methods and mattress covers of the present disclosure may be in many different forms and should not be construed as limited to the illustrated embodiments set forth herein; rather, these embodiments are provided so that this disclosure can be thorough and complete, and can fully convey its scope to those skilled in the art. Like numbers refer to like elements throughout.

The term "mattress cover" as used throughout this disclosure means a flat sheet, duvet, top sheet, mock duvet, duvet cover or any other means that may be used to cover a mattress. More specifically, embodiments disclosed relate to mattress covers that may be used in households, hotels, motels, and healthcare facilities, and their methods of manufacture.

Figure 1:
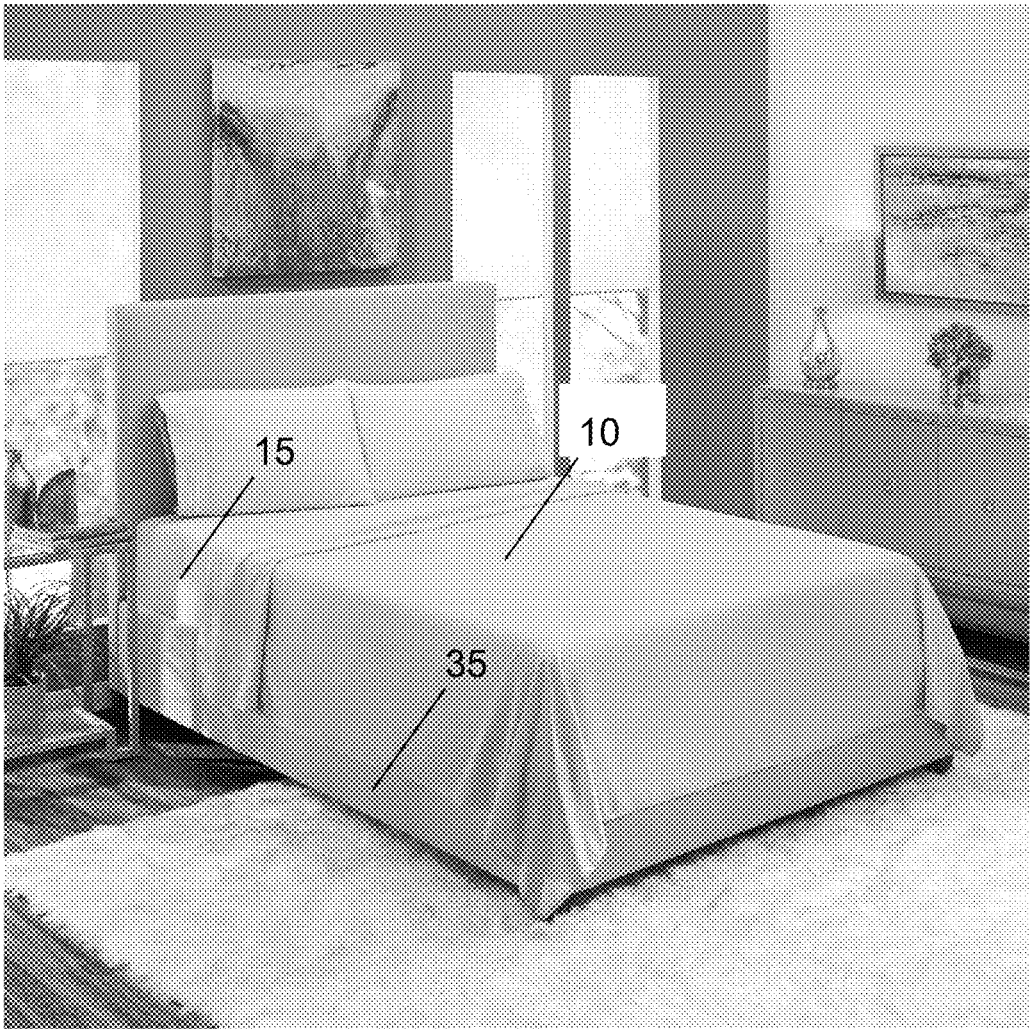
FIG. 1 (PRIOR ART)
FIG. 1 illustrates a set up including a conventional mattress carried by a platform bed, and a flat sheet spread on top of the mattress, according to the teachings of prior art.

Turning now to the figures, FIG. 1 is a prior art set up including a conventional mattress 15 carried by a platform bed 35, including a flat sheet 10 spread on top of the mattress, according to the teachings of prior art. The expression "mattress" referred to in the instant application refers to a fabric case filled with fillers including but not limited to one or more combinations of cotton, hair, feather, down, foam, rubber, springs, and the like. All embodiments claimed and described herein with regards to "mattress" are understood to include "mattress" used as a bed by itself, on a bedstead, water beds, air beds, "seat cushions" used on a sofa, couch, love seat, chair and the like, and tuffets.

Figure 2:
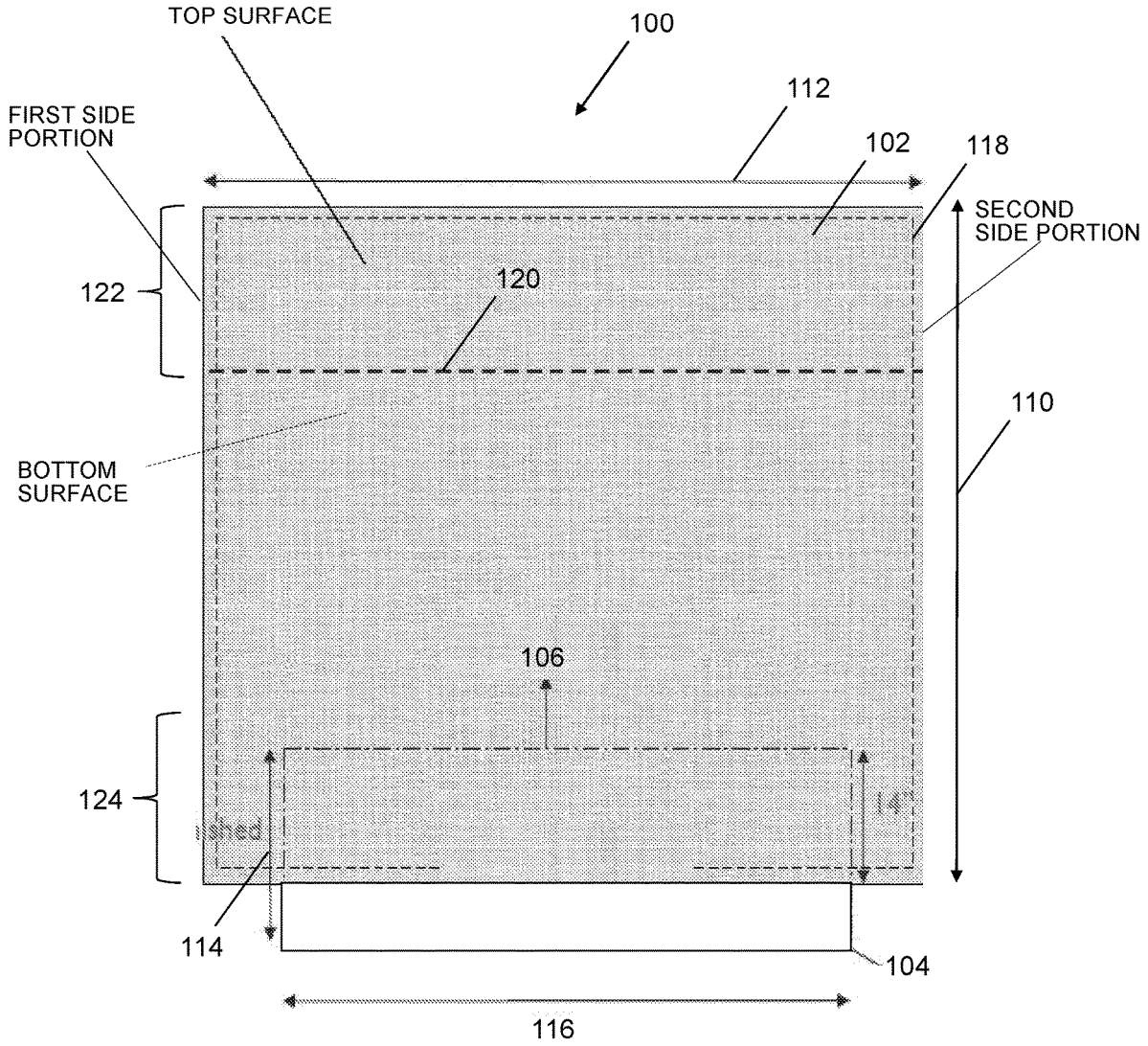
FIG. 2 illustrates a schematic representation of an exemplary mattress cover in accordance with an embodiment of the present disclosure.

FIG. 2 illustrates a mattress cover 100, according to one example embodiment. The mattress cover 100 includes a fabric substrate 102 having a top surface, a bottom surface, a head portion 122, a foot portion 124, a length 110, and a width 112. The mattress cover 100 also includes a secret tuck portion 104 attached to the foot portion 124 on the bottom surface of the fabric substrate 102. The secret tuck portion 104 has a length 114 and a width 116. In one embodiment, the width 116 of the secret tuck portion 104 is less than the width 112 of the fabric substrate 102. The length 114 of the secret tuck portion 104 may be significantly less than the length 110 of the fabric substrate 102. The secret tuck portion 104 is stitched or sewn to the foot portion 124 on the bottom surface of the fabric substrate 102. Alternatively, the secret tuck portion 104 may be attached to the foot portion 124 on the bottom surface of the fabric substrate 102 using a hook and loop type fastener or Velcro®, wherein one component of the hook and loop type fastener may be attached to the bottom surface of the fabric substrate 102 (across a portion of its width), and the other component of the hook and loop type fastener is attached to the secret tuck portion 104 (across its entire width).

In one embodiment, the width of the secret tuck portion 104 is equal to the width of a mattress on which the mattress cover 100 is used. For example, the mattress may be a twin, twin XL, full, queen, king, California king, or custom sized mattress. The secret tuck portion 104 can be attached to the foot portion 124 on the bottom surface (along dotted line 106) of the fabric substrate 102 at about 60-90% of the length 114 of the secret tuck portion 104, or preferably about 70-80% of the length 114 of the secret tuck portion 104. The secret tuck portion 104 can be made of the same material as the fabric substrate 102 or of a different material. For example, the secret tuck portion 104 may include a sheeting fabric, while the fabric substrate 102 can be a multilayered structure comprising two or more layers of a fabric. The secret tuck portion 104 may be foldable towards the bottom surface and concealed when not in use or when not tucked under the mattress. In one embodiment, the mattress cover 100 may include one or more layers of a second fabric.

In some embodiments, at least a portion of the secret tuck portion 104 of the mattress cover 100 is configured to be resilient and extendible along a depth of the mattress such that the mattress cover is releasably secured to the mattress. For example, at least one resilient member may be attached along one or more edges of the secret tuck portion 104 to provide for such a feature. The at least one resilient member can be sandwiched between two layers of a fabric in order to conceal the resilient member. The at least one resilient member may be attached in a vertical direction along the depth of the mattress or at an angle relative to the vertical direction.

Turning now to FIG. 2, a fabric weight of the fabric substrate 102, the second fabric, and/or the secret tuck portion 104 can be in the range of about 10 gsm to 1000 gsm. The fabric substrate 102, the second fabric, and/or the secret tuck portion 104 may include at least one of cotton, polyester, nylon, and rayon yarns in either warp and/or weft direction. For example, the fabric substrate 102, the second fabric, and/or the secret tuck portion 104 may include 100% polyester yarns. The fabric substrate 102, the second fabric, and/or the secret tuck portion 104 may include at least one of a woven, knitted, nonwoven, and extruded base. In one embodiment, the fabric substrate 102, the second fabric, and/or the secret tuck portion 104 may have a patterned or textured surface so as to improve the aesthetic appearance and/or tactile feel of the mattress cover. The yarn density of the warp and weft yarns can be in the range of about 25 to 500 denier.

In one example embodiment, a portion of the head portion 122 is folded backwards towards the bottom surface of the mattress cover 100, and seams 118 are provided along an outer edge of the side portions to retain the head portion in a folded position. Additional seaming 120 may be provided along the folded portion and across the width of the mattress cover 100 such that the seam 120 would only appear on the bottom surface of the fabric substrate.

In one embodiment, at least a portion of the side portions may be configured to be resilient and extendible along a depth of a mattress such that the mattress cover is releasably secured to the mattress. For example, at least one resilient member may be configured to be sandwiched between two layers of a fabric, or the seam portion may be made resilient. In another embodiment, at least one resilient member is attached along corners that conform with corners of the mattress. In one embodiment, at least one resilient member is attached in a vertical direction along the depth of the mattress or at an angle relative to the vertical direction. In one embodiment, the mattress cover may also include one or more layers of fabric stiffeners, resilient material and the like in at least some portions of the sheets. The expression "resilient" referred to in the instant application refers to a property of a material that enables it to return to its original shape after being pulled or stretched. The expression "resilient member" referred to in the instant application may include elastomeric materials that are inherently resilient by nature, such as elastic and also materials that can be pulled or tugged and released by means of ropes, cords, drawstrings configured therein to achieve desired tensioning or release effect. The expression "resilient member" may also include fabric configured with resilience by techniques such as but not limited to smocking and shining. "Resilient member" in the instant application can take any form including but not limited to bands, tapes, strips, threads, and the like, which may be produced using Lycra®, Spandex®, and the likes, an elastomer, polyurethane, or any other polymeric material. The expressions "sew" and "stitch" may be used interchangeably to imply fastening or joining by stitching or other forms of bonding, as known in the art and may be a manual process or may involve use of machines.

Another example embodiment is a method of making a mattress cover including providing a fabric substrate 102 having a top surface, a bottom surface, a head portion 122, a foot portion 124, a first length 110, and a first width 112. The method further includes attaching a secret tuck portion 104 to the foot portion 124 on the bottom surface of the fabric substrate 102, the secret tuck portion having a second length 114 and a second width 116, wherein the second width 116 is less than the first width 112. The second length 114 may be significantly less than the first length 110. The secret tuck portion 104 may be stitched or sewn to the foot portion 124 on the bottom surface of the fabric substrate 102, or the secret tuck portion 104 may be attached to the foot portion 124 on the bottom surface of the fabric substrate 102 using a hook and loop type fastener or Velcro®, wherein one component of the hook and loop type fastener may be attached to the bottom surface of the fabric substrate 102 (across a portion of its width), and the other component of the hook and loop type fastener is attached to the secret tuck portion 104 (across its entire width).

In one embodiment, the width of the secret tuck portion 104 is equal to the width of a mattress on which the mattress cover 100 is used. For example, the mattress may be a twin, twin XL, full, queen, king, California king, or custom sized mattress. The secret tuck portion 104 can be attached to the foot portion 124 on the bottom surface (along dotted line 106) of the fabric substrate 102 at about 60-90% of the length 114 of the secret tuck portion 104, or preferably about 70-80% of the length 114 of the secret tuck portion 104. The secret tuck portion 104 can be made of the same material as the fabric substrate 102 or of a different material. For example, the secret tuck portion 104 may include a sheeting fabric, while the fabric substrate 102 can be a multilayered structure comprising two or more layers of a fabric. The secret tuck portion 104 may be foldable towards the bottom surface and concealed when not in use or when not tucked under the mattress. In one embodiment, the mattress cover 100 may include one or more layers of a second fabric.

In some embodiments, at least a portion of the side portions of the mattress cover 100 is configured to be resilient and extendible along a depth of a mattress such that the mattress cover is releasably secured to the mattress. The at least one resilient member is further configured to be sandwiched between two layers of a fabric. The at least one resilient member, for example, may be attached along corners that conform with corners of the mattress. The at least one resilient member may be attached in a vertical direction along the depth of the mattress or at an angle relative to the vertical direction.

Turning now to FIG. 2, a fabric weight of the fabric substrate 102, the second fabric, and/or the secret tuck portion 104 can be in the range of about 10 gsm to 1000 gsm. The fabric substrate 102, the second fabric, and/or the secret tuck portion 104 may include at least one of cotton, polyester, nylon, and rayon yarns in either warp or weft direction. The fabric substrate 102, the second fabric, and/or the secret tuck portion 104 may include 100% polyester yarns. The fabric substrate 102, the second fabric, and/or the secret tuck portion 104 may include at least one of a woven, knitted, nonwoven, and extruded base. The fabric substrate 102, the second fabric, and/or the secret tuck portion 104 may have a patterned or textured surface. The yarn density of the warp and weft yarns can be in the range of about 25 to 500 denier.

In one embodiment, a portion of the head portion 122 is folded backwards towards the bottom surface of the mattress cover 100, and seams 118 are provided along an outer edge of the side portions to retain the head portion in a folded position. Additional seaming 120 may be provided along the folded portion and across the width of the mattress cover 100 such that the seam 120 would only appear on the bottom surface of the fabric substrate.

The present disclosure provides various embodiments to achieve resilience and meet the intended objects of the disclosure. In an embodiment, at least a portion of the side surfaces can be configured to be resilient. For instance, at least a portion of the side surfaces can be made of stretchable material such as Lycra® or Spandex® and the like. In an embodiment, corners of the side surfaces that conform to the four corners of the mattress on which the contour sheet may be spread can be made of such resilient material. Alternatively, spaced apart portions of the side surfaces can be made of such resilient material. In another embodiment, the side surfaces can be monolithic and made entirely of such resilient material.

Furthermore, this invention is applicable not only to fluid-cell mattress but any type of mattress with a filler material. It is also possible to use a mattress main body using metal springs such as coil springs or spring steel linear materials instead of air spring of the cells, or a mattress main body whose entirety is formed of a polymeric elastomer like a polyurethane foam.

It will be appreciated by a person skilled in the art that although the mattress cover 100 has been described with respect to a mattress, the mattress cover 100 may alternatively be used on a box spring. Further, the mattress cover 100 may be provided in different sizes and shapes for use with mattresses, box springs, couch cushions, chair cushions, pillows and duvets, for example, or any stuffed or filled article (whether stuffed or filled by natural or man-made materials).

The mattress cover disclosed here can take the form of any of the following: bed skirts, contour sheets or fitted sheets that cover the mattress, top sheets or flat sheets, blankets or duvets and pillow shams among other items. The mattress cover not only provides comfort, but also provide the advantage of the washed regularly instead of frequently washing the mattresses, thereby providing equivalent effect of cleanliness and hygiene, which in turn increases user convenience and reduces associated costs and resources on a recurring basis. Additionally, these items also provide an appealing bed presentation especially with appropriate color combinations and designs. However, an important aspect from the point of view of aesthetic appeal, comfort and safety is how well the bedding items are laid and avert accidents due to overhanging portions that may cause tripping.

The mattresses covers in the present disclosure can be customized to fit any standard mattress size such as King, Queen, Twin, Full, and the like. The mattress cover disclosed in the above embodiments is a critical and basic item in bedding sets that is laid over the mattress and is intended to snugly fit the mattress. Such covers can also find application for seat cushions in sofas, couches, love seats, and tuffets. With varying depths of mattresses and seat cushions available in the market today, there is a need to ensure that mattress covers are standardized for a particular size and are yet able to cater to the varying depths of mattresses or cushions available for each size.

The Specification, which includes the Summary, Brief Description of the Drawings and the Detailed Description, and the appended Claims refer to particular features (including process or method steps) of the disclosure. Those of skill in the art understand that the invention includes all possible combinations and uses of particular features described in the Specification. Those of skill in the art understand that the disclosure is not limited to or by the description of embodiments given in the Specification.

Those of skill in the art also understand that the terminology used for describing particular embodiments does not limit the scope or breadth of the disclosure. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise.

As used in the Specification and appended Claims, the singular forms "a," "an," and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "operatively connecting" and its conjugated forms means to complete any type of required junction, including electrical, mechanical or fluid, to form a connection between two or more previously non-joined objects. If a first component is operatively connected to a second component, the connection can occur either directly or through a common connector. "Optionally" and its various forms means that the subsequently described event or circumstance may or may not occur. The description includes instances where the event or circumstance occurs and instances where it does not occur.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or operations are in any way required for one or more implementations or that one or more implementations necessarily include logic for deciding, with or without user input or prompting, whether these features, elements, and/or operations are included or are to be performed in any particular implementation.

The mattress covers and methods described herein, therefore, are well adapted to carry out the objects and attain the ends and advantages mentioned, as well as others inherent therein. While example embodiments of the mattress cover and method have been given for purposes of disclosure, numerous changes exist in the details of procedures for accomplishing the desired results. These and other similar modifications may readily suggest themselves to those skilled in the art, and are intended to be encompassed within the spirit of the mattress cover and method disclosed herein and the scope of the appended claims.

What is claimed is:

1. A mattress cover comprising:

a fabric substrate having a top surface, a bottom surface, a head portion, a foot portion, a first length, and a first width; and a secret tuck portion attached to the foot portion on the bottom surface of the fabric substrate, wherein the secret tuck portion is directly stitched or sewn to the foot portion on the bottom surface of the fabric substrate, the secret tuck portion having a second length and a second width, wherein the second width is less than the first width, wherein at least a portion of the secret tuck portion is configured to be resilient and extendible along a depth of a mattress such that the mattress cover is releasably secured to the mattress, wherein a first portion of the secret tuck portion overlaps with the foot portion and a second portion of the secret tuck portion hangs off the foot portion.

2. The mattress cover according to claim 1, wherein the second length is less than the first length.

3. The mattress cover according to claim 1, wherein the secret tuck portion is attached to the foot portion on the bottom surface of the fabric substrate using a hook and loop fastener.

4. The mattress cover according to claim 1, wherein the secret tuck portion is attached to the foot portion on the bottom surface of the fabric substrate, at a location about 60-90% of the second length of the secret tuck portion.

5. The mattress cover according to claim 4, wherein the secret tuck portion is attached to the foot portion on the bottom surface of the fabric substrate, at a location about 70-80% of the second length of the secret tuck portion.

6. The mattress cover according to claim 1, wherein the secret tuck portion is made of the same material as the fabric substrate or of a different material.

7. The mattress cover according to claim 1, wherein the fabric substrate comprises one or more layers of a fabric.

8. The mattress cover according to claim 7, wherein a fabric weight of the fabric substrate is in a range of about 10 gsm to 1000 gsm.

9. The mattress cover according to claim 7, wherein the fabric substrate comprises at least one of cotton, polyester, nylon, and rayon yarns in either warp or weft direction.

10. The mattress cover according to claim 9, wherein a yarn density of the warp and weft is in a range of about 25 to 500 denier.

11. The mattress cover according to claim 7, wherein the fabric substrate comprises 100% polyester yarns.

12. The mattress cover according to claim 7, wherein the fabric substrate comprise at least one of a woven, knitted, nonwoven, and extruded base.

13. The mattress cover according to claim 7, wherein the fabric substrate has a patterned or textured surface.

14. The mattress cover according to claim 1, wherein the secret tuck portion comprises a sheeting fabric.

15. The mattress cover according to claim 1, wherein the secret tuck portion is foldable towards the bottom surface and concealed when not in use or when not tucked under the mattress.

16. The mattress cover according to claim 1, wherein the second width is equal to a width of the mattress on which the mattress cover is used.

17. A method of making a mattress cover comprising:

providing a fabric substrate having a top surface, a bottom surface, a head portion, a foot portion, a first length, and a first width; and attaching a secret tuck portion to the foot portion on the bottom surface of the fabric substrate, wherein the secret tuck portion is directly stitched or sewn to the foot portion on the bottom surface of the fabric substrate, the secret tuck portion having a second length and a second width, wherein the second width is less than the first width, wherein at least a portion of the secret tuck portion is configured to be resilient and extendible along a depth of a mattress such that the mattress cover is releasably secured to the mattress, wherein a first portion of the secret tuck portion overlaps with the foot portion and a second portion of the secret tuck portion hangs off the foot portion.

18. The method according to claim 17, wherein the second width is equal to a width of the mattress on which the mattress cover is used.

19. The method according to claim 17, wherein the secret tuck portion is attached to the foot portion on the bottom surface of the fabric substrate using a hook and loop fastener.

20. The method according to claim 17, wherein the secret tuck portion is attached to the foot portion on the bottom surface of the fabric substrate, at a location about 60-90% of the second length of the secret tuck portion.

* * * * *